US007682493B2

(12) United States Patent
Yamamoto et al.

(10) Patent No.: US 7,682,493 B2
(45) Date of Patent: Mar. 23, 2010

(54) ELECTRODE CARTRIDGE AND A SYSTEM FOR MEASURING AN INTERNAL STRESS FOR A FILM OF PLATING

(75) Inventors: Wataru Yamamoto, Tokyo (JP); Katsunori Akiyama, Tokyo (JP); Fumio Harada, Tokyo (JP); Yutaka Tsuru, Fukuoka (JP)

(73) Assignee: Yamamoto-MS Co., Ltd., Tokyo (JP)

( * ) Notice: Subject to any disclaimer, the term of this patent is extended or adjusted under 35 U.S.C. 154(b) by 1422 days.

(21) Appl. No.: 11/049,304

(22) Filed: Feb. 3, 2005

(65) Prior Publication Data

US 2005/0189220 A1 Sep. 1, 2005

(30) Foreign Application Priority Data

Feb. 3, 2004 (JP) ..... 2004-027300

(51) Int. Cl.
*B23H 3/04* (2006.01)

(52) U.S. Cl. ..... 204/286.1; 204/297.01; 204/287; 204/289

(58) Field of Classification Search ..... 204/434, 204/279–297.1, DIG. 7; 702/42; 205/81, 205/84; 324/450; 422/82.01
See application file for complete search history.

(56) References Cited

U.S. PATENT DOCUMENTS 2,675,348 A * 4/1954 Greenspan ..... 204/297.05
4,086,154 A 4/1978 Hicks
4,648,944 A 3/1987 George et al.
4,786,376 A * 11/1988 Vaaler ..... 205/67
4,986,130 A * 1/1991 Engelhaupt et al. ..... 73/760

(Continued)

FOREIGN PATENT DOCUMENTS

DE 199 36 036 A1 2/2001

(Continued)

OTHER PUBLICATIONS

Yutaka Tsuru et al.: "Development of the measuring system for mean internal stress in nickel film plated on cooper substrate", Electrochemistry and Physicochemistry, vol. 60, No. 9, Sep. 1992, pp. 780-784, XP009095959.

(Continued)

*Primary Examiner*—Nam X Nguyen
*Assistant Examiner*—Bach T Dinh
(74) *Attorney, Agent, or Firm*—Berenato & White, LLC

(57) ABSTRACT

The electrode cartridge for measuring an internal stress of a film of plating includes a cathode support, an anode support, a shield plate and an anode shell. The anode support supports an anode plate so that the anode plate is opposite to the cathode plate with a predetermined spacing. The shield plate is interposed between the cathode and anode plates. A through hole is made in the shield plate in such a manner that the through hole confronts a plating section and has a geometry which is reduced by a first predetermined scale factor relative to a geometry of the plating section. An opening is made in the anode shell in such a manner that the opening confronts the plating section and has a geometry which is magnified by a second predetermined scale factor relative to the geometry of the plating section.

6 Claims, 8 Drawing Sheets

U.S. PATENT DOCUMENTS

| | | | | |
|---|---|---|---|---|
| 5,149,419 | A * | 9/1992 | Sexton et al. | 205/75 |
| 5,227,046 | A * | 7/1993 | Murphy et al. | 205/252 |
| 2002/0040849 | A1 * | 4/2002 | Yamamoto | 204/434 |
| 2003/0079995 | A1 | 5/2003 | Contolini et al. | |

FOREIGN PATENT DOCUMENTS

| | | |
|---|---|---|
| JP | 2000-002598 | 1/2000 |
| JP | 2002-115092 | 4/2002 |

OTHER PUBLICATIONS

Tsuru et al., "Development of the Measuring System for Mean Internal Stress in Nickel Film Plated on Copper Substrate", Denki Kagaku, pp. 780-784.

* cited by examiner

A
C
11d
15b
15a
11b
16c
CP
11c
11a
16d
14a
13a
13
16g
15c
15b

A
12a
12b
16a
12c
16b
14a
13a
13
16i
14
16h

A
D
12d
C
15a
11d
11a
HG
CP
14b
14
14a
13a
13
15b
15c
16g
D

ELECTRODE CARTRIDGE AND A SYSTEM FOR MEASURING AN INTERNAL STRESS FOR A FILM OF PLATING

BACKGROUND OF THE INVENTION

The present invention relates to an electrode cartridge with a strain gauge which is applied to measurement of an internal stress for a film of plating and a system for implementing the measurement with the electrode cartridge.

Of late years plating has been extensively applied to a surface of metal. The smaller becomes the size of an object to which plating is applied, the higher requirements have been imposed on a thinner film of plating and its performance. Especially in the field of semiconductors, it has come to require that a thickness and width of plating be controlled to be as small as some nanometers.

It is necessary to optimize conditions of electro deposition such as composition of a plating liquid, a current density, a speed of agitation and a temperature of plating liquid so as to constantly obtain a best film of plating. It sometimes happens in a generally known method for plating that characteristics of a film of plating drift as composition of a plating liquid progressively departs from its original ones, even if optimized conditions are established at starting of plating. This leads to a necessity that conditions be controlled by continuous monitoring of a plating bath so that stable characteristics of a film of plating may be maintained. One example of monitoring conditions of a plating bath is to measure an internal stress of a film of plating (hereinafter shortly referred to as "internal plating stress" if necessary). A conventional apparatus for measuring an internal stress of a film of plating includes an apparatus using a spiral stress meter. Description is given of this apparatus (hereinafter referred to as "spiral plating stress meter" if necessary).

As shown in FIG. 7, a spiral plating stress meter 50 holds a test sample 51 of a spirally formed member around both a support shaft 52 with a clamp 53 and a rotational shaft 57 with a clamp 54. An inner surface (back surface) of the test sample 51 is coated with fluorescent resin so that a film of plating is formed only on its outer surface (front surface). The support shaft 52 is a cylindrical member having a hollow portion. The clamp 53 connected to a lower end portion of the support shaft 52 holds an upper end portion of the test sample 51. The rotational shaft 57 is a slender pole, which rotatably penetrates the hollow portion of the support shaft 52. An upper end portion of the rotational shaft 57 is connected to a pointer of a transducer 56 and its lower end portion to the clamp 54. In this way, torsion of the test sample 51 is transmitted to the rotational shaft 57, which produces a rotation of the pointer of the transducer 56.

When the spiral plating stress meter 50 is placed in a tank filled with a plating liquid and a current is supplied between the meter 50 and an anode plate by a power supply (not shown), a front surface of the test sample 51 is plated, which creates an internal stress in the test sample 51 and a resulting rotation of the rotational shaft 57. The transducer 56 transforms the rotation into a torsion angle ($\alpha$), so that the meter 50 measures an internal plating stress ($\sigma$), which can be calculated by an expression (1).

$$\sigma=(2k/pt)\times(\alpha/d) \quad (1)$$

where k is a spiral constant (mm·N/deg), p a pitch of spiral (mm), t a thickness of spiral plate (mm), $\alpha$ a torsion angle (deg) and d a thickness of plating (mm).

Although the spiral plating stress meter 50 is able to measure an internal stress of plating with relatively high accuracy, it is difficult to apply the meter 50 for measurement of a minute stress because it is necessary to read a pointer of the transducer 56 with the naked eye. Also it is burdensome for a person in charge when he reads the pointer at predetermined intervals so as to monitor a change in internal stress, which the spiral plating stress meter 50 is able to provide real time. Furthermore, because the pointer of the transducer 56 is read by the person with the naked eye, there is another problem that an error resulting from reading occurs.

As reading is performed for the pointer of the transducer 56 with the naked eye in the spiral plating stress meter 50, it is necessary for the pointer to displace so much that the displacement is visible to the naked eye. The smaller is stiffness of the test sample 51, the more rotational displacement makes the pointer of the transducer 56. Accordingly, the thinner is the test sample 51, the smaller stress it is theoretically possible to measure. However, there has been a problem that it is impossible to accurately measure an internal stress of a film of plating if the stiffness of the test sample 51 is decreased (the thickness of test sample 51 is reduced). This attributes to the fact that deformation of the test sample 51 releases the internal stress of the film of plating, thereby giving a misleading smaller value. In other words, the spiral plating stress meter 50 has limitations in terms of the accuracy of measurement for an internal stress of a film of plating.

On the other hand, another method for measuring an internal stress of a film of plating has been studied using a principle of strain gauge, which is reported in a non-patent document, Yutaka Tsuru et al. Development of the Measuring System for Mean Internal Stress in Nickel Film Plated on Copper Substance page 780-784 DENKI KAGAKU Vol. 60 No. 9, September 1992.

This method uses a strain gauge which is attached to a back surface of a cathode plate. The strain gauge measures distortion (minute deformation) of the cathode plate which results from an internal stress of a film of plating. In this way, the method calculates the internal stress based on the distortion.

FIG. 8 is a sectional view illustrating a distribution of voltage in a plating tank according to a conventional apparatus for measuring an internal stress of a film of plating using a strain gauge. A conventional apparatus 60 for measuring an internal stress of a film of plating includes a plating tank 61, a cathode plate C, an anode plate A, a shield plate 62. The plating tank 61 is filled with a plating liquid. The cathode plate C and the anode plate A are disposed so that these two plates mutually confront with a predetermined spacing. The shield plate 62, which has a through hole 62*a* of a predetermined size, is interposed between the cathode plate C and the anode plate A. A strain gauge HG is attached to a back surface of a plating section of the cathode plate C.

An accurate measurement for an internal stress of a film of plating with the apparatus 60 requires a uniform thickness of the film of plating, which is formed on the cathode plate C as an object to be plated. As shown in FIG. 8, the apparatus 60 is accordingly adapted to provide equipotential lines which are parallel with the cathode plate C. This is realized by not only placing the shield plate 62 having the through hole 62*a*, but also adjusting appropriately a spacing between the cathode plate C and the shield plate 62 as well as a spacing between the shield plate 62 and the anode plate A. In this way, the distribution of voltage within the tank is properly adjusted, so that it is possible to form a uniform thickness of a film of plating.

Japanese Published Patent Application 2000-002598 filed by the present applicant is listed here for information, which discloses an apparatus for measuring an internal stress of a film of plating.

However, in order to acquire a uniform thickness of a film of plating, it has been required to adjust (1) the spacing between the cathode plate C and the shield plate 62 as well as the spacing between the anode plate A and the shield plate 62, (2) a ratio of width between the through hole 62*a* and the cathode plate C and (3) geometrical relationship in a direction of height between the through hole 62*a* and the plating section of the cathode plate C. When an adjustment is manually done, it has sometimes taken much time or it has been sometimes impossible to obtain a uniform thickness of a film of plating due to a poor adjustment. This has occurred oftener when a measurement is made for an internal stress of a very thin film of plating.

Even if the adjustments such as (1) to (3) are successfully carried out, it has sometimes occurred that the width of the anode plate A varies due to its dissolution in continuing plating. This leads to a change in equipotential lines, thereby disarranging their parallelism relative to the cathode plate C. In this way, there has been a problem that a uniform thickness of a film of plating can not be obtained and an internal stress can not be accurately measured accordingly.

When a power supply is connected to both cathode plate C and anode plate A to supply current, hydrogen ions ($H^+$) collect on a surface of the cathode plate C, forming pits (recesses) on a film of plating. If a large number of pits are created, it is impossible to accurately measure an internal stress of a film of plating. To solve this problem, it is necessary to prepare a device for removing the hydrogen ions, which collect on the film of plating. Methods for removing the hydrogen ions include one for providing vibration for the cathode plate C and another for blowing off the hydrogen ions by spraying the cathode plate C with bubbles. However, the method using vibration has had an adverse effect on measurement of strain gauge to create noises. On the other hand, the method using bubbles has sometimes affected conditions of a film of plating due to a variation in position of bubbles injected. In this way, when an adjustment is manually made for the geometrical relationship between the cathode plate C and injection holes, it has been difficult to guarantee the repeatability of a film of plating due to a fine deviation of the geometrical relationship, which results in degradation of accuracy for measurement of an internal stress of a film of plating.

SUMMARY OF THE INVENTION

The present invention seeks to solve disadvantages described above and to provide not only an electrode cartridge which is able to perform an accurate and easy measurement for an internal stress of a film of plating using a strain gauge, but also a system for measuring an internal stress of a film of plating with the electrode cartridge.

It is an aspect of the present invention to provide an electrode cartridge which is applied to measurement of an internal stress for a film of plating. The electrode cartridge comprises a cathode support, an anode support, a shield plate and an anode shell. The cathode support supports a cathode plate in a plating liquid, and the cathode plate has a plating section, to a back surface of which a strain gauge is attached. The anode support supports an anode plate in the plating liquid so that the anode plate is opposite to the cathode plate with a predetermined spacing. The shield plate is interposed between the cathode plate and the anode plate. The anode shell surrounds a periphery and an end portion of the anode plate in the plating liquid. A through hole is made in the shield plate in such a manner that the through hole confronts the plating section and has a geometry which is reduced by a first predetermined scale factor relative to a geometry of the plating section. An opening is made in the anode shell in such a manner that the opening confronts the plating section and has a geometry which is magnified by a second predetermined scale factor relative to the geometry of the plating section.

The electrode cartridge described above enables an arrangement that the cathode plate and the anode plate not only mutually confront with the predetermined spacing but also have a predetermined relationship in terms of size which is given by the through hole and the opening described above. This arrangement dispenses with fine tuning for not only the disposition of the cathode plate and the anode plate but also the spacing between them, thereby providing an easier measurement for an internal stress of a film of plating.

Furthermore, the electrode cartridge described above, which is able to maintain a constant width (size) of the opening of the anode shell in spite of a change in a width of the anode plate due to dissolution, keeps a distribution of voltage within the plating liquid so as to be parallel with the cathode plate in its vicinity. In other words, it is possible to obtain a uniform thickness for a film of plating without an adverse effect resulting from dissolution of the anode plate. Therefore, it is possible to accurately and easily measure an internal stress of the film of plating. The width of the anode plate is preferably, but not necessarily, adapted to be greater than that of the opening so that the anode plate fully occupies the width of the opening even if the width of the anode plate decreases due to dissolution.

In this connection, a width and height of the through hole of the shield plate of the electrode cartridge are preferably, but not necessarily, adapted to be 0.4 to 0.8 times as large as those of the plating section, respectively. Also, a width and height of the opening of the anode shell are preferably, but not necessarily, adapted to be 1.1 to 1.3 times as large as those of the plating section. Selection of these sizes is able to prevent a thickness of the film of plating in the vicinity of edges of the plating section from being thicker than its other areas.

It is another aspect of the present invention to provide an electrode cartridge further comprising a bubble supplying device. The bubble supplying device extends from the cathode support to a portion opposite to a lower end of the cathode plate and injects bubbles from this portion.

The electrode cartridge described above, which obviates an adjustment for a relative position between the cathode plate and bubbles, is able to keep constantly spray the cathode plate with the bubbles. Because it is possible to prevent forming of pits without adjustment, guaranteeing the repeatability of film of plating, it is possible to accurately and easily measure an internal stress of the film of plating.

It is still another aspect of the present invention to provide a system for measuring an internal stress for a film of plating with an electrode cartridge, which comprises a plating tank, a power supply, a measurement device and a computer. The plating tank stores the plating liquid, in which the electrode cartridge supporting the cathode plate and the anode plate, is soaked. The power supply is electrically connected to the cathode plate and the anode plate. The measurement device is electrically connected to the strain gauge attached to the cathode plate. The computer calculates the internal stress for the film of plating based on results obtained by the measurement device in addition to characteristics of the cathode plate and the film of plating.

The system described above, which is equipped with the electrode cartridge, is able to provide an accurate and easier measurement for an internal stress of a film of plating. This is attributed to the fact that only if electrodes are placed in the electrode cartridge, it is possible to form a uniform thickness of the film of plating without cumbersome positioning of the electrodes and shield plate. In this way, the system provides an accurate and easy measurement for an internal stress of plating.

Furthermore, the system having the computer is able to measure a finer change in internal stress compared with a spiral plating stress meter, whose divisions are read with the naked eye. Because signals sent by the strain gauge are electrically incorporated into the measurement device, the system is able to obtain a change in internal stress in the form of electronic data. In addition, because the system solves a human error in reading, it is able to provide a more accurate and easier measurement for an internal stress of plating.

In this connection, the power supply includes a pulse power supply and an alternating-current power supply, for example, in addition to a direct-current power supply. It is possible for the computer to use an expression (2) to calculate an internal stress for a film of plating, for example. The computer includes a commercial personal computer and the like.

$$\sigma = Et^2\delta/[3(1-\nu)dl^2] \quad (2)$$

where σ is an internal stress of film of plating, l a length of plating section of cathode plate, t a thickness of cathode plate, E Young's modulus of cathode plate, v Poisson's ratio of cathode plate, δ a deflection of cathode plate and d a thickness of film of plating.

The electrode cartridge and the system provide an accurate and easy measurement using a strain gauge for a measurement of an internal stress of a film of plating. In this way, it is possible to constantly obtain a best film of plating if conditions for plating are adjusted based on results measured by the system.

Because a strain gauge is able to measure a minute deformation of a cathode plate, it is possible to accurately and easily measure an internal stress of a film of plating which is formed thin enough for a use in a so-called nanotechnology.

DESCRIPTION OF THE PREFERRED EMBODIMENTS

Figure 1:
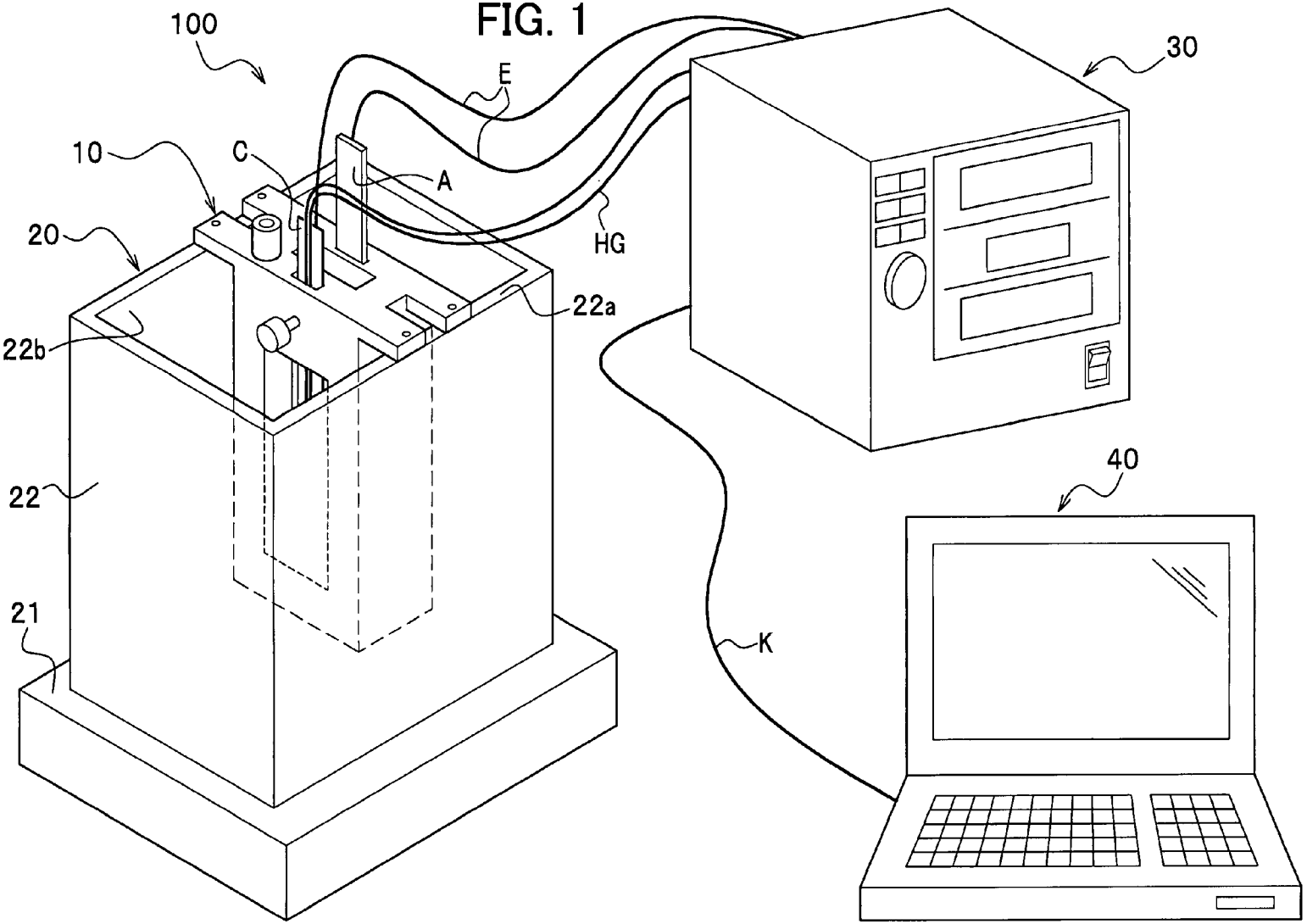
FIG. 1 is a perspective view illustrating a system for measuring an internal stress of a film of plating according to the present invention.

An embodiment of the present invention is now described with reference to accompanying drawings. When the same element appears in different drawings, the same symbol is consistently used in these drawings. After description is given of the element once, no repetition will be made.

a. Structural Description of a System for Measuring an Internal Stress of a Film of Plating As shown in FIG. 1, a system 100 for measuring an internal stress of a film of plating includes an electrode cartridge 10, a plating tank 20, a measurement device 30 and a note personal computer 40. The electrode cartridge 10 is equipped with a cathode plate C and an anode plate A. The plating tank 20 stores a plating liquid. The measurement device 30 is electrically connected to a strain gauge HG, which is attached to the cathode plate C. The note personal computer 40 calculates an internal stress of a film of plating based on results measured by the measurement device 30. In this connection, it is assumed that the measurement device 30 has a direct-current power supply to supply power required for plating.

The electrode cartridge 10 supports the cathode plate C and the anode plate A in the plating liquid. The electrode cartridge 10 is soaked in the plating liquid filled in a reservoir portion 22 of the plating tank 20 to be described later. Lower end portions of the cathode plate C and the anode plate A are soaked in the plating liquid accordingly. The electrode cartridge 10 is supported on a top surface 22*a* of the reservoir portion 22 by flanges extending from the sides of the electrode cartridge 10. In this way, upper end portions of the cathode plate C and the anode plate A are exposed above the plating liquid. Detailed description is given of the structure of the electrode cartridge 10 later with reference to FIG. 2.

Power cables E are electrically connected to the upper end portions of the cathode plate C and the anode plate A so that power is supplied to these plates C and A. The strain gauge HG is attached to the cathode plate C (see FIG. 2) and electrically connected to the measurement device 30. Description in detail will be given later to structure of the cathode plate C and the anode plate A with reference to FIG. 2.

The plating tank 20, in which the electrode cartridge 10 is installed, serves as a tank for storing the plating liquid. The plating tank 20 includes a base 21 and a reservoir portion 22. The base 21 is a base structure for supporting the reservoir portion 22. The reservoir portion 22 is a rectangular parallelepiped having an upper opening. A hollow portion 22*b* of the reservoir portion 22 is filled with the plating liquid (not shown).

The electrode cartridge 10 and the plating tank 20 are preferably, but not necessarily, made of glass or plastic material, which is not susceptible to corrosion caused by a plating liquid, such as acryl, polypropylene and fluororesin.

The measurement device 30 measures a distortion of the cathode plate C based on a change in electric resistance (voltage signal) of the strain gauge HG (see FIG. 2), which is attached to the cathode plate C. The measurement device 30, which is equipped with an equivalent circuit (Wheatstone bridge) including the strain gauge HG, for example, is able to measure a distortion of the cathode plate C based on a change in electric resistance of the strain gauge HG. Furthermore, the measurement device 30 is able to send signals of measured distortions to the note personal computer 40 via connecting cables K.

Having a direct-current power supply, the measurement device 30 is able to supply current to a circuit including the cathode plate C and the anode plate A. A supplied current and its period of time are sent to the personal computer 40, where they are used for calculation of a thickness of a film of plating and the like. It is possible to control the direct-current power supply of the measurement device 30 according to a current and a period of time for supplying power which are determined in advance so that a thickness of a film of plating to be formed meets a predetermined value. In this case, it may be possible to input the current and the period of time in the personal computer 40 in advance.

The note personal computer 40 calculates an internal stress based on a distortion of the cathode plate C measured by the measurement device 30. The note personal computer 40, which is electrically connected to the measurement device 30 via the connecting cables K, is able to receive data measured by the measurement device 30. The note personal computer 40 calculates an internal stress of a film of plating with the expression (2) described above, based on a result (distortion) of measurement by the strain gauge HG, characteristic values (thickness, length, Young's modulus, Poison's ratio and the like) of the cathode plate C (plating section CP) and a characteristic value (thickness) of the film of plating. Internal stress $\sigma$ is shown on a display in the form of a graph, which helps a person engaged in a measurement have a better understanding of an internal stress for a film of plating.

In this connection, it may be alternatively possible for the note personal computer 40 to calculate a deflection ($\delta$) based on a distortion ($\epsilon$) measured by the measurement device 30, using their relationship which is experimentally obtained in advance.

b. Structure of Electrode Cartridge

Referring to FIGS. 2-6, description is given of structure of the electrode cartridge 10.

As shown in FIGS. 2-6, the electrode cartridge 10 includes a cathode support 11, an anode support 12, a shield plate 13, an anode shell 14 (see FIG. 5), a bubble supplying device 15 and a connecting portion 16 which connects these components 11-15.

The cathode support 11 includes a main portion 11*a*, flanges 11*b* and 11*c*, a cathode slot 11*d* and a bolt 11*e*. The cathode support 11 supports the cathode plate C which is inserted into the cathode slot 11*d* while the electrode cartridge 10 is soaked in the plating liquid.

The main portion 11*a*, which is a member similar to a rectangular parallelepiped, has the flanges 11*b* and 11*c*, which extend laterally from its both longitudinal ends. When the electrode cartridge 10 is soaked in the plating tank 20, the flanges 11*b* and 11*c* rest on the upper end portion 22*a* of the reservoir portion 22 so as to support the electrode cartridge 10 (main portion 11*a*).

Figures 4A, 4B, 4C:
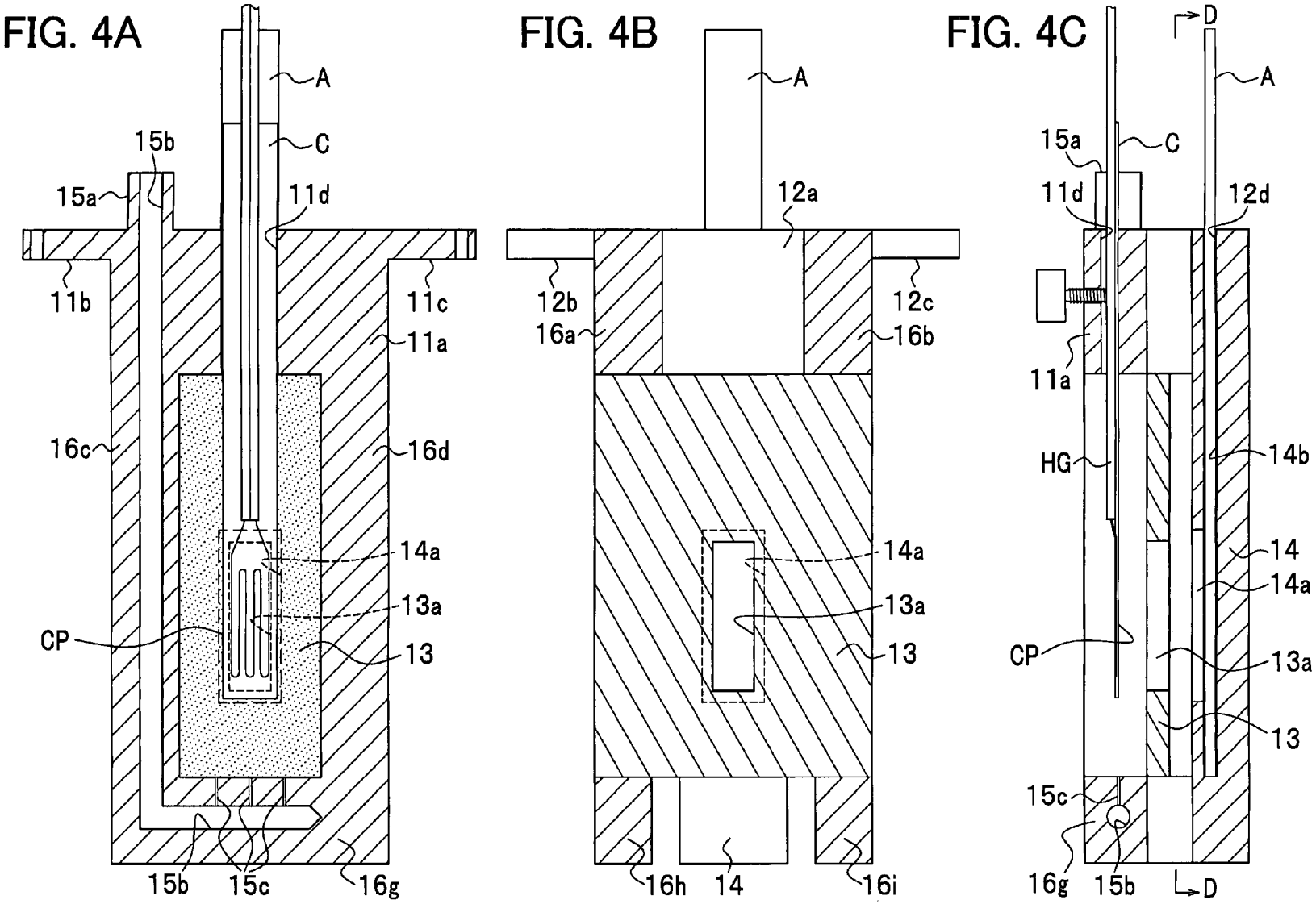
FIGS. 4A-4C are sectional views taken along lines A-A, B-B and C-C in the top view of FIG. 3, respectively.

The cathode slot 11*d* through which the cathode plate C is inserted is bored in the middle of the main portion 11*a* (see FIG. 4A). The main portion 11*a* has the bolt 11*e*, which is for adjusting and holding a vertical position of the cathode plate C.

Using the flanges 11*b* and 11*c*, the cathode support 11 with the cathode plate C inserted in the cathode slot 11*d*, which is secured by the bolt 11*e*, rests on the upper end portion 22*a* of the plating tank 20. In this way, it is possible to install the main portion 11*a* in the hollow portion 22*b* of the reservoir portion 22. The cathode plate C is supported by the main portion 11*a* in such a manner that a lower portion of the cathode C is soaked in the plating liquid and at the same time its upper portion is above the surface of the plating liquid.

Description is given of the cathode plate C, which is supported by the cathode support 11.

The cathode plate C, which is shaped like a slender plate (rectangular slice) made of electrically conductive material, serves as an object to be plated. At one end portion of the cathode plate C a plating section CP to be plated is formed, on which a film of plating is deposited. The plating section CP is formed by applying an insulating coating to the cathode plate C except for the plating section CP, for example. On the back surface of the plating section CP is attached the strain gauge HG, which is for measuring a distortion of the cathode plate C. The cathode plate C is installed in the cathode slot 11*d* while its plating section CP is directed downwardly. The position of the cathode C is adjusted by the bolt 11*e* so that the plating section CP vertically positioned so as to confront a through hole 13*a* of the shield plate 13. In this connection, it may be alternatively possible to prepare a projection on an upper portion of the cathode plate C so as to obviate vertical adjustment. This projection is preferably, but not necessarily, formed so that a center of the plating section CP vertically coincides with both a center of the through hole 13*a* and a center of an opening 14*a* of the anode shell 14 when the projection comes into contact with an upper surface of the main portion 11*a*. The cables E, which originate from a direct-current power supply belonging to the measurement device 30, are connected to the other end portion of the cathode plate C.

Although a thickness (t) of the cathode plate C is not limited in the present invention, an exemplary value may be preferably, but not necessarily, on the order of 0.6 mm. Similarly, an exemplary value for a length (l) of the plating section CP may be preferably, but not necessarily, on the order of 25 mm. It is possible to obtain Young's modulus (E) and Poisson's ratio (v), which are intrinsic to a lot of metal used for the cathode plate C, by testing and a certificate accompanying the lot.

The anode support 12 includes a main portion 12*a*, flanges 12*b* and 12*c* and an anode slot 12*d*. The anode support 12 supports the anode plate A, which is inserted into the anode slot 12*d*, in the plating liquid. The anode support 12 is structurally similar to the cathode support 11 except for the bolt 11*e*, a counterpart of which the anode support 12 does not have.

Figure 3:
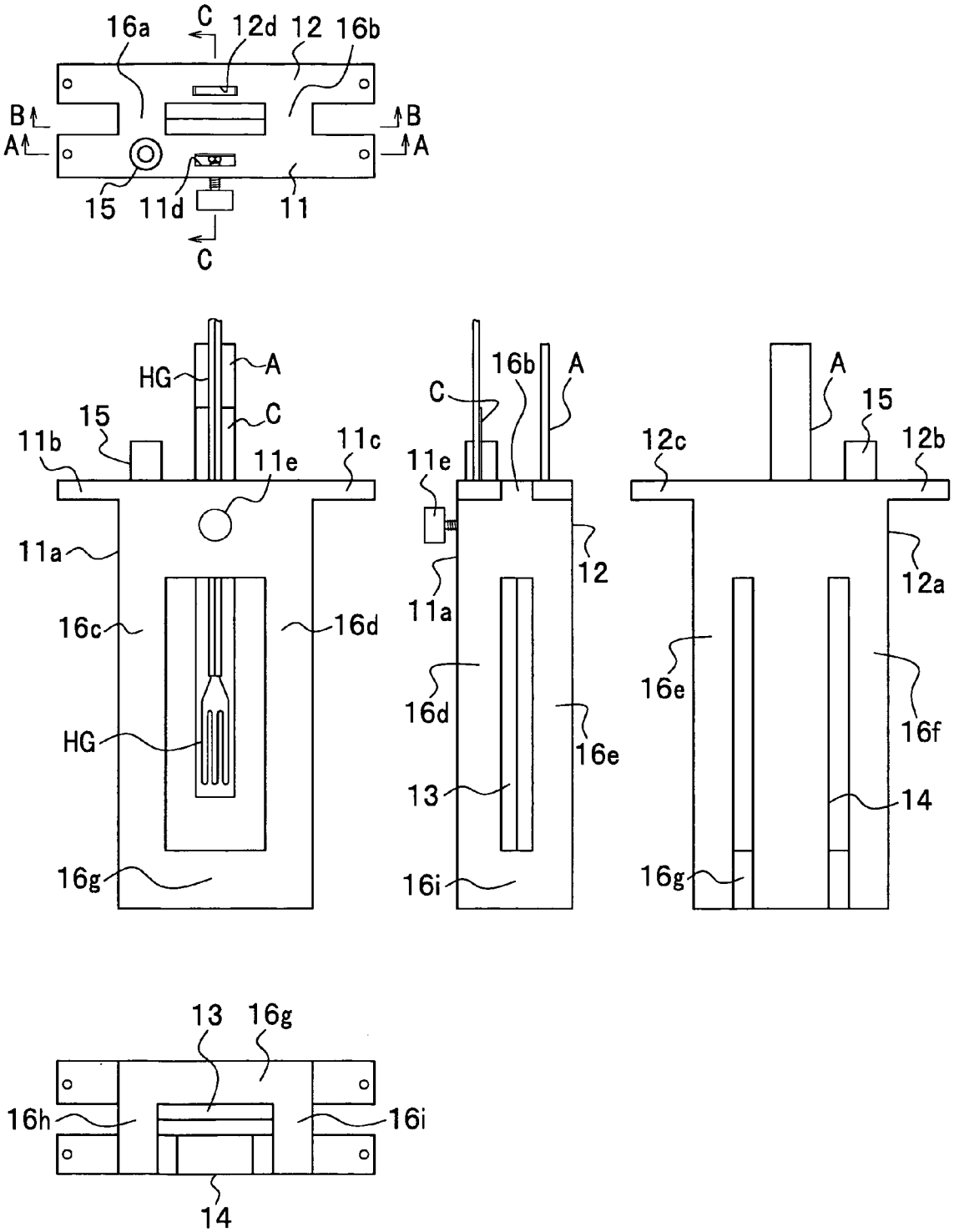
FIG. 3 is six views (top, front, right side, left side, back and bottom views) illustrating an electrode cartridge.

The main portion 12*a* of the anode support 12, which is a member shaped like a rectangular parallelepiped, is mechanically connected (secured) to the main portion 11*a* of the cathode support 11 with a predetermined spacing via a connecting portion 16 (16*a* and 16*b*) (see FIG. 3). The spacing is adjusted so that a thickness of a film of plating is uniform. The flanges 12*b* and 12*c*, which extend from both end portions of the main portion 12*a*, rest on the upper end portion 22*a* of the plating tank 22. The anode slot 12*d* runs through the main portion 12*a* in a vertical direction, confronting the cathode slot 11*d*. When the anode plate A is inserted in the anode slot 12*d*, it will confront the cathode plate C.

Description is given of the anode plate A, which is supported by the anode support 12.

The anode plate A is an electrode which is shaped like a slender plate made of electrically conductive material, which is normally the same as that dissolved in a plating liquid. For example, in the case of nickel plating a material belonging to a nickel family is used. If the anode plate A is not dissolvable, it may be possible to select a material different from the plating liquid. The anode plate A is vertically supported while contacting with the anode shell 14 (see FIG. 5) formed under the anode slot 12*d*.

The shield plate 13, which is a plate-like member and placed between the cathode plate C and the anode plate A, has a through hole 13*a* at a predetermined position (see FIG. 4A), which is geometrically analogous to the plating section CP of the cathode plate C. The shield plate 13 having the through hole 13*a* adjusts a distribution of voltage within the plating liquid so as to be parallel with the cathode plate C. The shield plate 13 is connected to side surfaces of connecting portions 16*c* and 16*d*. Both lower end portions of the connecting portions 16*c* and 16*d* are connected by a connecting portion 16*g*. A vertical length of the shield plate 13 is adapted to be equal to a length from a lower surface of the main portion 11*a* of the cathode support 11 to an upper surface of the connecting portion 16*g*. In this way, an envelope encompassed by the connecting portions 16*c*, 16*d* and 16*g* in addition to the main portion 11*a* is shielded except for the through hole 13*a* relative to the anode plate A. When the surface of the plating liquid is lower than the upper end of the shielding palter 13, it may not be necessarily required that the upper end of the shielding plate 13 contact with the lower surface of the main portion 11*a*.

Figure 5:
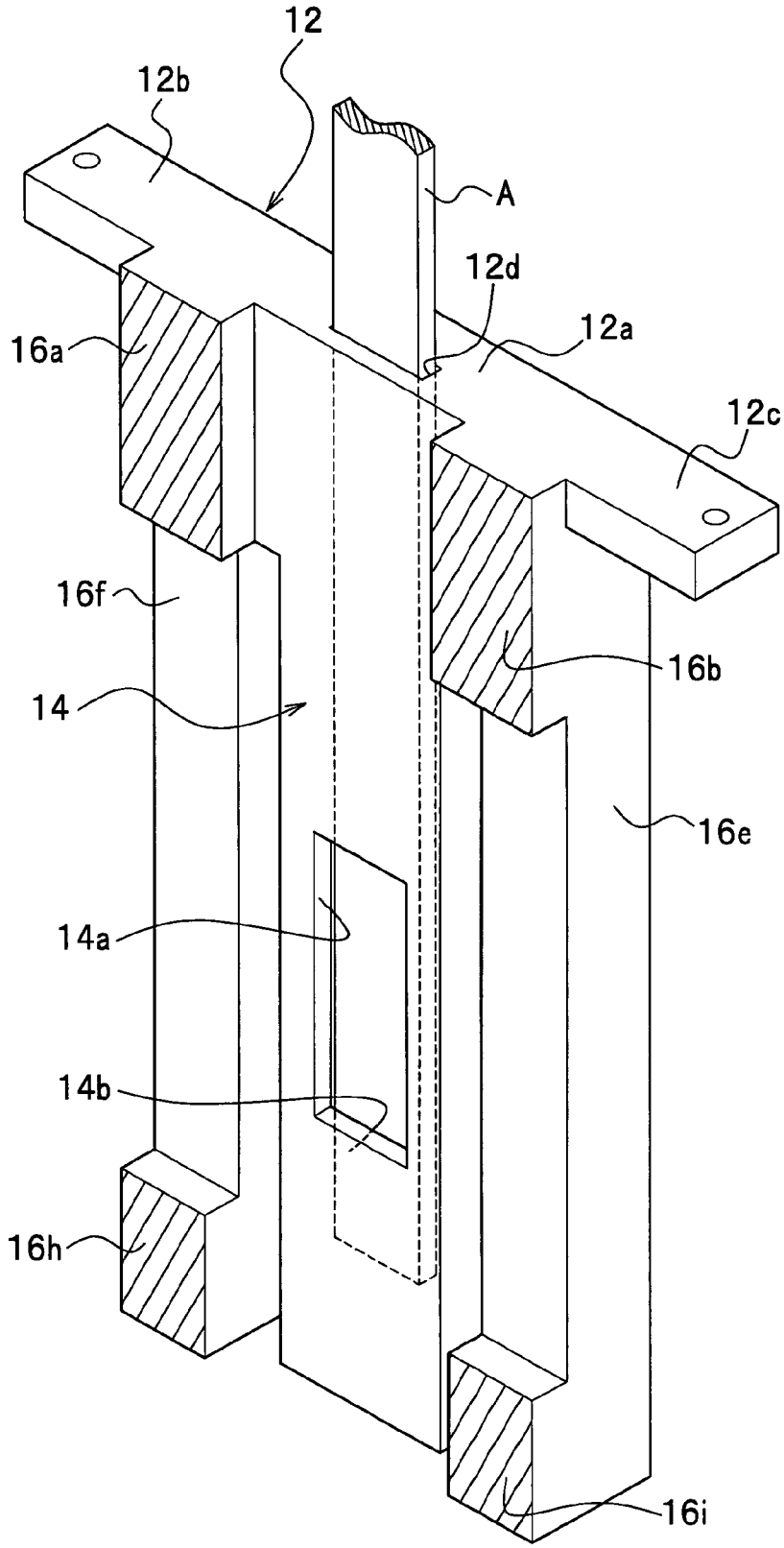
FIG. 5 is a perspective view as seen from line D-D in FIG. 4C.

As shown in FIG. 5, the anode shell 14, which is a member of tube with a bottom base surrounding both the anode plate A and its lower end portion, extends from the lower surface of the main portion 12*a* of the anode support 12. A hollow portion 14*b* of the anode shell 14, which communicates with the anode slot 12*d* made in the main portion 12*a*, is able to surround the anode plate A which is inserted through an upper opening of the anode slot 12*d*. On its side surface confronting the cathode plate C, the anode shell 14 has an opening 14*a*, which is geometrically analogous to the plating section CP (rectangular in the present embodiment, for example) of the cathode C and communicates with the hollow portion 14*b*. The opening 14*a* is formed so that it confronts the through hole 13*a* of the shielding 13 (their centers of figure coincide).

Figure 6:
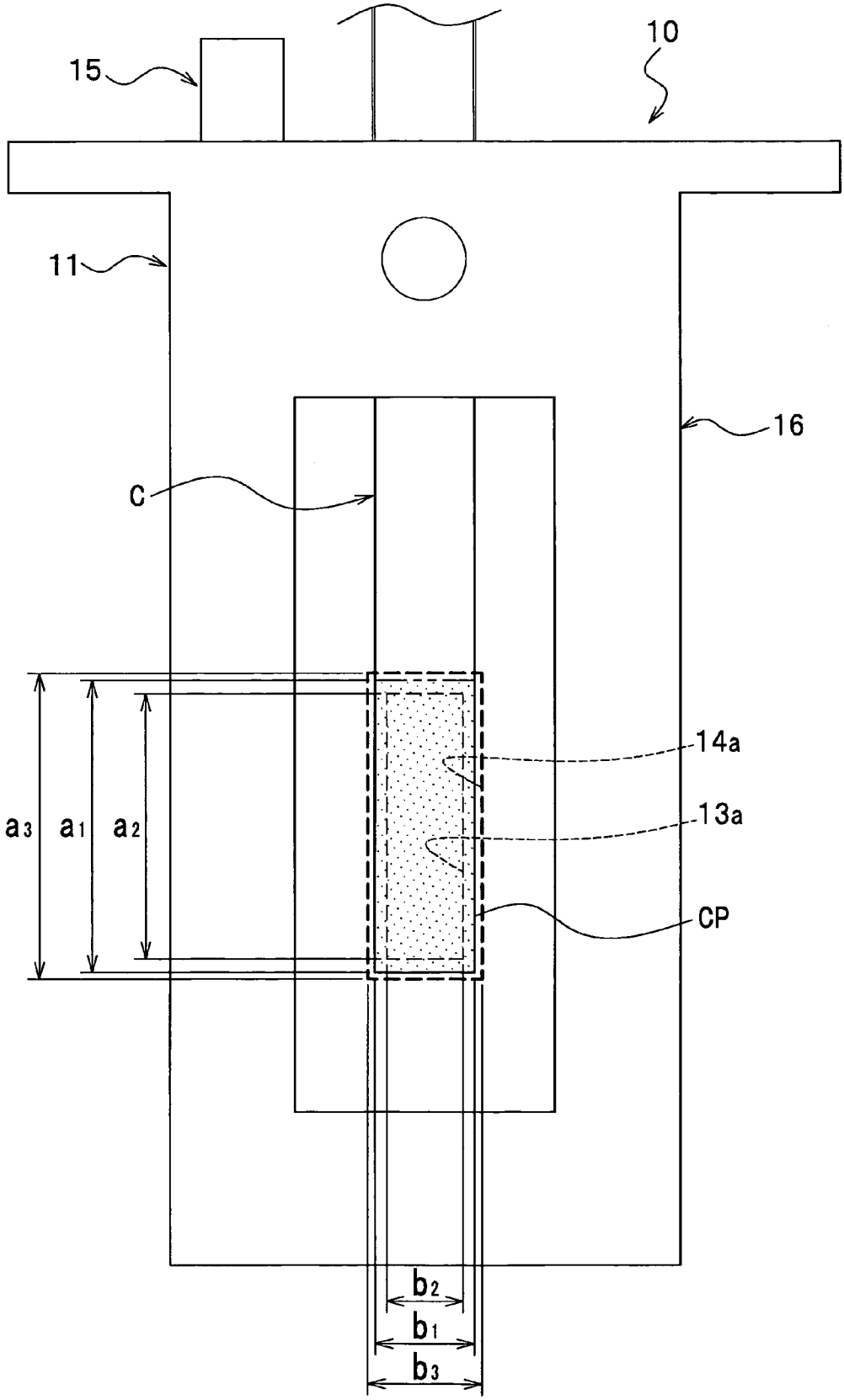
FIG. 6 is a schematic diagram illustrating the geometrical relationship among a plating section of a cathode plate, a through hole of a shield plate and an opening of an anode shell.
Figure 7:
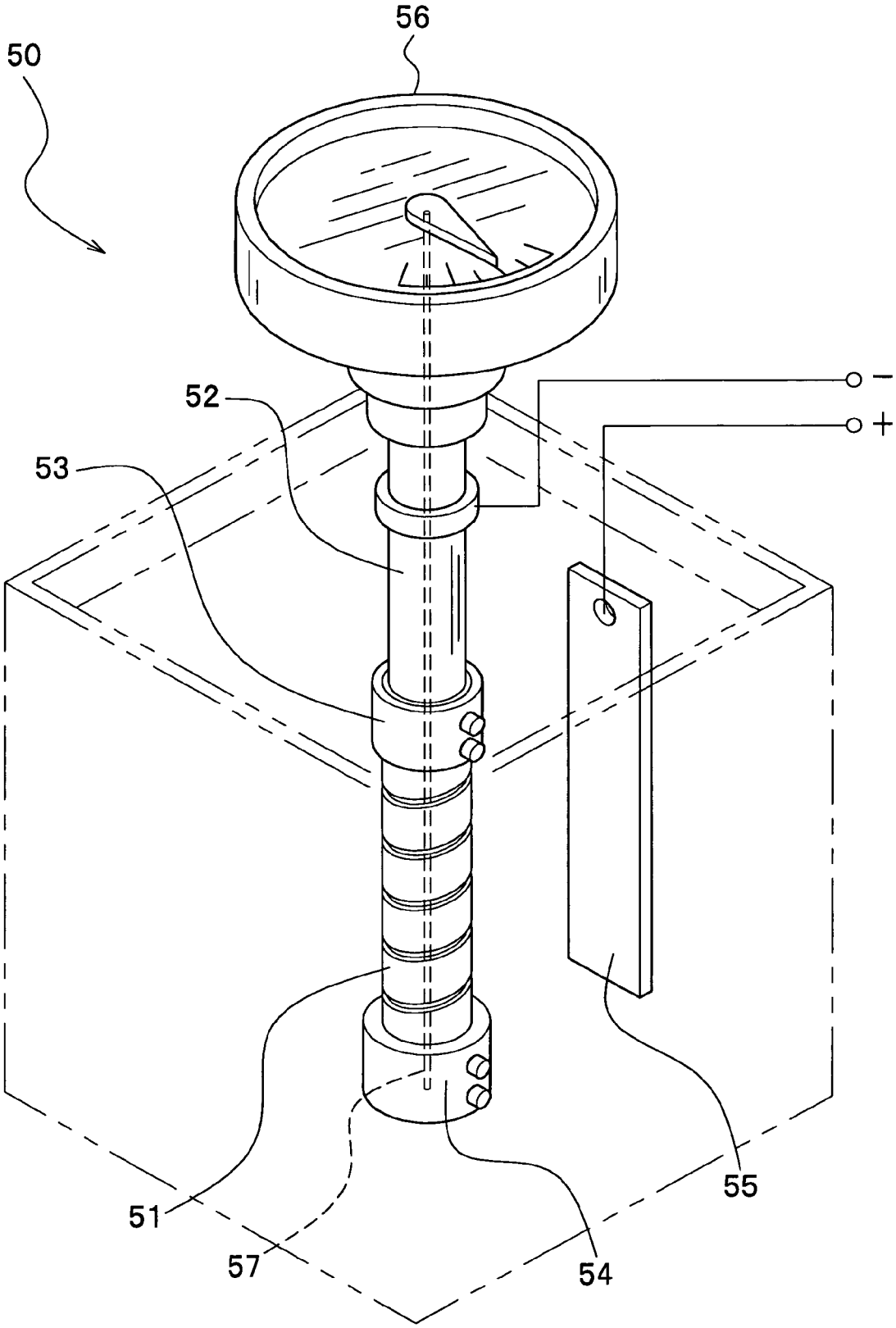
FIG. 7 PRIOR ART
FIG. 7 is a perspective view illustrating a conventional spiral plating stress meter.
Figure 8:
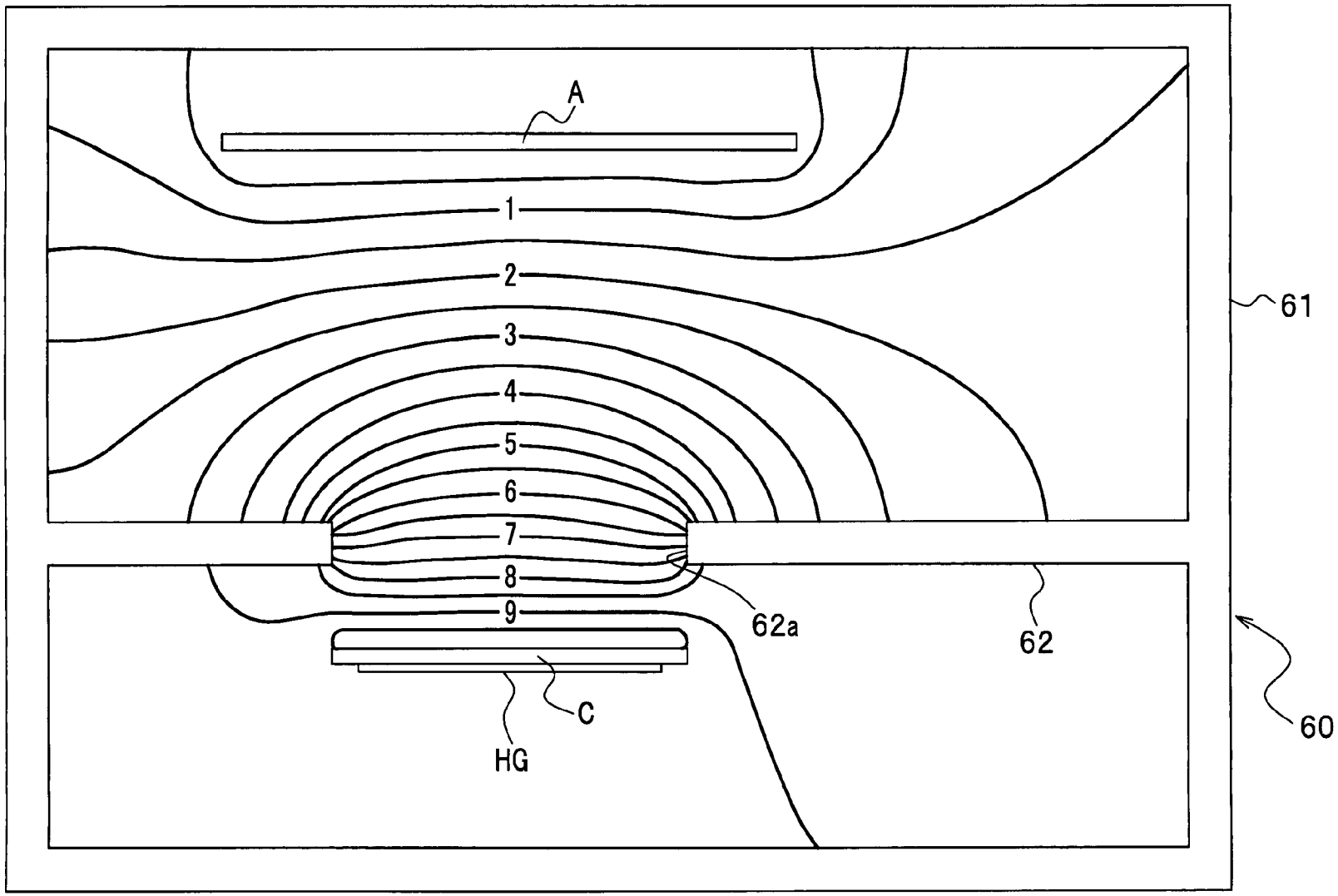
FIG. 8 PRIOR ART
FIG. 8 is a sectional view illustrating a distribution of voltage within a plating tank according to a conventional apparatus for measuring an internal stress of a film of plating using a strain gauge.

Description is given of the relationship among the plating section CP of the cathode plate C, the through hole 13*a* of the shield plate 13 and the opening 14*a* of the anode shell 14 with reference to FIG. 6.

FIG. 6 is a front view illustrating the plating section CP, the through hole 13*a* and the opening 14*a* in an overlapped fashion.

As shown in FIG. 6, the plating section CP, the through hole 13*a* and the opening 14*a* are positioned so that their centers of figure coincide with each other, as seen from the front of the electrode cartridge 10.

The through hole 13*a* of the shield plate 13 is adapted to be analogous to the geometry of the plating section CP with a predetermined reduction scale. In this connection, the width and height of the through hole 13*a* are preferably, but not necessarily, adapted to be 0.4 to 0.8 times as large as those of the CP. For example, assuming a reduction scale of 0.7, the width and height of the through hole 13*a* result in:

$$a_2=0.7\times a_1,$$

$$b_2=0.7\times b_1,$$

where $a_1$ is a longitudinal length (height) of the plating section CP, $b_1$ is a lateral length (width) of the plating section CP, $a_2$ is a longitudinal length (height) of the through hole 13*a* and $b_2$ is a lateral length (width) of the through hole 13*a* (see FIG. 6).

The opening 14*a* of the anode shell 14 is adapted to be analogous to the geometry of the plating section CP with a predetermined magnification scale. In this connection, the width and height of the opening 14*a* are preferably, but not necessarily, adapted to be 1.1 to 1.3 times as large as those of the plating section CP. For example, assuming a magnification scale of 1.2, the width and height of the through hole 13*a* result in:

$$a_3=1.2\times a_1,$$

$$b_3=1.2\times b_1,$$

where $a_3$ is a longitudinal length (height) of the opening 14*a* and $b_3$ is a lateral length (width) of the opening 14*a* (see FIG. 6).

An advance arrangement, which is applied to the plating section CP, the through hole 13*a* and the opening 14*a* with the scales described above, makes it possible to easily obtain a uniform thickness of a film of plating, only if the cathode plate C is installed in the electrode cartridge 10.

The bubble supplying device 15, which is for injecting bubbles from the opposite position relative to the lower end of the cathode plate C, includes a tube connection port 15*a*, an air supply path 15*b* and injection holes 15*c*.

Figure 2:
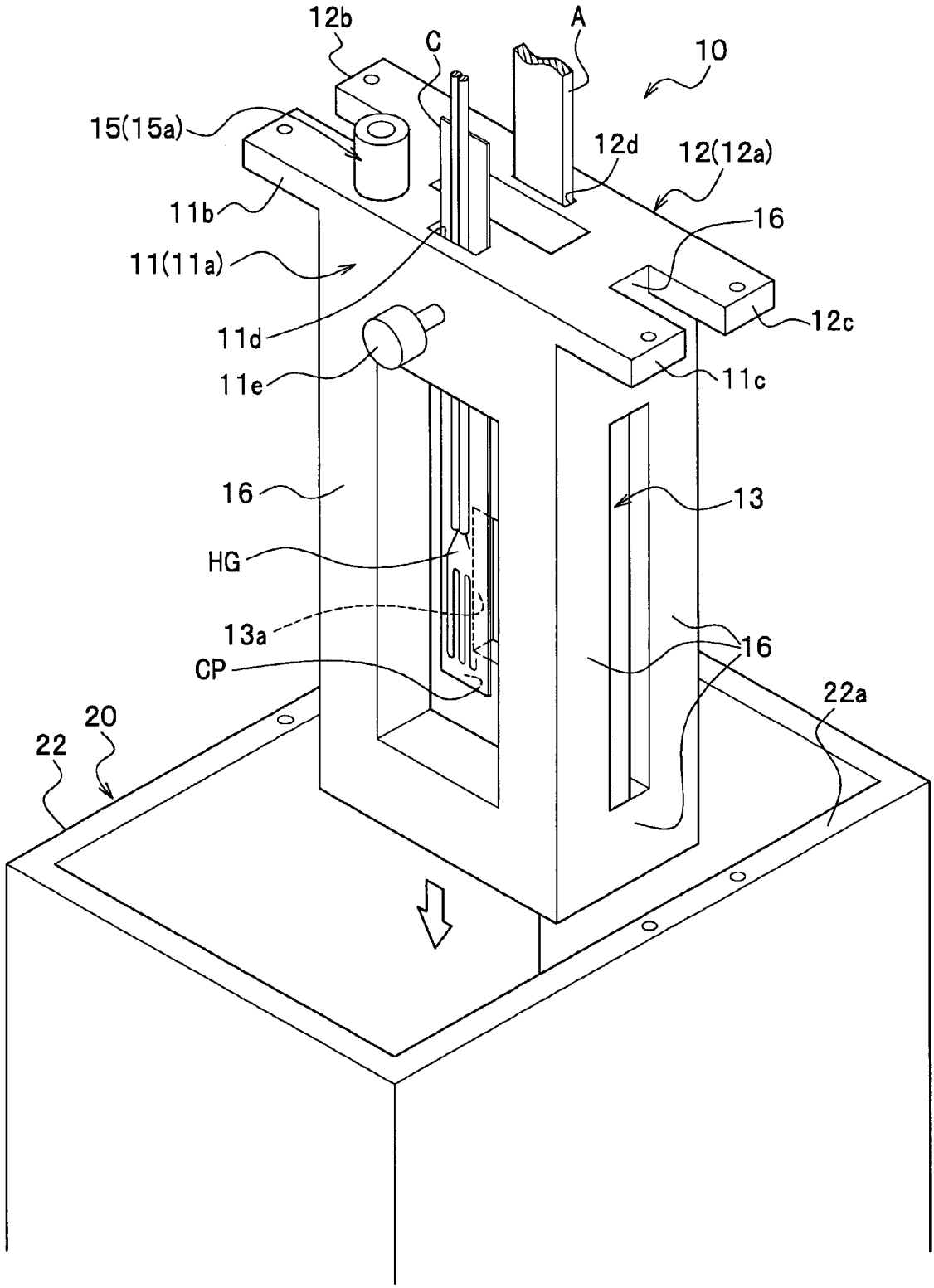
FIG. 2 is a perspective view illustrating a plating tank and an electrode cartridge installed with a cathode plate and anode plate.

As shown in FIG. 2, the tube connection port 15*a* is a cylindrical member, which projects from an upper surface of the main portion 11*a* of the cathode support 11. The tube connection port 15*a* accommodates connection of a tube (not shown) coming from an air pump (not shown). The air supply path 15*b*, through which air is supplied by the air pump to a lower end portion of the cathode plate C, extends from a hollow portion of the tube connection port 15*a* to the connecting portion 16*g* via the main portion 11*a* and the connecting portion 16*c*. The injection holes 15*c* extend from the air supply path 15*b*, penetrating the connecting portion 16*g*, which confronts the lower end portion of the cathode plate C. In this way, the injection holes 15*c* are able to inject bubbles toward the cathode plate C.

When bubbles injected through the injection holes 15*c* hit the plating section CP, they carry hydrogen ions which collect on the surface of a film of plating. This prevents hydrogen ions from collecting on the surface of a film of plating, thereby avoiding creation of pits. As the position of the injection holes 15*c* is fixed, there is no fear that the relative position between the cathode plate C and the injection holes 15*c* shifts, which will improve the repeatability of a film of plating.

As shown in FIG. 2, the connecting portion 16 is a member to connect and secure a combination of components so that they are positioned and spaced in a predetermined manner. The combination includes one made of the cathode support 11 and the anode support 12, one made of the cathode support 11 and the shield plate 13 as well as the other one made of the anode support 12 and the shield plate 13. As long as the material used for fasteners and adhesives are not dissolved into a plating liquid, it may be possible to select any type of connection such as adhesion, mating and fastening with a bolt.

The connecting portions 16*a* and 16*b* connect the cathode support 11 and the anode support 12 with a predetermined spacing, thereby providing a desirable spacing between the cathode plate C and the anode plate A. In this connection, it may be possible to obviate the connecting portions 16*a* and 16*b* if a cathode support 11 and an anode support 12 are integrally formed as one member, different from the present embodiment in which these two supports 11 and 12 are separate. In the former case, the positions of the slots 11*d* and 12*d* are adjusted so that a desirable spacing between the cathode plate C and the anode plate A is obtained.

The connecting portions 16*c* and 16*d* extend downwardly from the lower surface of the main portion 11*a* so as to support the shield plate 13. The lower ends of the connecting portions 16*c* and 16*d* are connected with each other by the connecting portion 16*g*. In the present embodiment, the air supply path 15*b* and the injection holes 15*c* are formed inside these connecting portions 16*c* and 16*g*. This requires no dedicated members to supply bubbles, thereby bringing about structural simplification of the electrode cartridge 10 and its easy production.

Connecting portions 16*e* and 16*f* extend downwardly from the lower surface of the main portion 12*a*. Connecting portions 16*h* and 16*i* connect ends of the connecting portions 16*c* and 16*d* and ends of the connecting portions 16*e* and 16*f*. In this way, the shield plate 13, which is attached to the connecting portions 16*c* and 16*d*, is more securely supported. Lower ends of the connecting portions 16*e* and 16*f* and a lower end of the anode shell 14 are not connected, but bottomless slits are formed between the connecting portion 16*e* and the anode shell 14 and between the connecting portion 16*f* and the anode shell 14, respectively. If an anode bag (not shown) is installed in the anode shell 14 using these slits, it is possible to prevent anode slime generated by the anode plate A from giving an adverse effect on a film of plating.

c. Method for Using an Electrode Cartridge

Description is given of a method for using of an electrode cartridge 10 with reference to FIGS. 2-6.

First, a cathode plate C, in which a strain gauge HG is attached to a back surface of a plating section CP, is inserted into a cathode slot 11*d* of a cathode support 11. During this step, the cathode plate C is inserted so that not only an end portion closer to the plating section CP is directed downwardly, but also the plating section CP is confronted an anode plate A. Also the cathode plate C is adjusted by a bolt 11*e* so that the center of plating section CP coincides with both the center of a through hole 13*a* of a shield plate 13 and the center of an opening 14*a* of an anode shell 14.

The anode plate A is inserted into an anode slot 12*d* of an anode support 12. The anode plate A is then inserted into a hollow portion 14*b* of the anode shell 14 which is adapted to communicate with a lower portion of the anode slot 12*d*. The anode plate A is supported by the anode support 12 while resting on the bottom surface of the hollow portion 14*b*.

Accordingly, the cathode plate C and the anode plate A are positioned with a predetermined spacing, being opposite to each other. Also, the plating section CP of the cathode plate C, the through hole 13*a* of the shield plate 13 and the opening 14*a* of the anode shell 14 are positioned so as to meet a predetermined geometrical relationship. This results in elimination of adjustment not only for spacing between the cathode plate C and the anode plate A but also for their relative geometry, which will provide an easier measurement for internal stress of a film of plating.

When the temperature difference between a plating liquid and a cathode plate C is large, it is preferable but not required that the temperature of the cathode plate C is adapted to be close to that of the plating liquid. An example to realize this is preheating which is conducted for the cathode plate C using a tube such as a test tube with water, which is soaked in the plating liquid filled in a plating tank 20. In this way, it is possible to decrease an adverse effect of a deformation of the cathode plate C induced by temperature change, providing an accurate measurement of pure deformation (distortion) of the cathode plate C resulting from formation of a film of plating. The preheating tube provided in the plating tank 20 allows an easy adjustment for setting the temperature of the cathode plate C close to that of a plating liquid without a dedicated device.

Next, the electrode cartridge 10, in which the cathode plate C and the anode plate A is installed, is soaked in the plating liquid stored in the plating tank 20. Flanges 11*b*, 11*c*, 12*b* and 12*c* of the electrode cartridge 10 are rested on an upper end portion 22*a* of a reservoir portion 22 so that only a lower portion of the electrode cartridge 10 is soaked in the plating liquid but its upper portion, where power cables E originating from a power supply are connected to upper end portions of the cathode plate C and the anode plate A, stays above the surface of the plating liquid.

d. Method for Using a System for Measuring an Internal Stress of a Film of Plating Description is given of a method for using a system 100 for measuring an internal stress of a film of plating with reference to FIG. 1.

First, power cables E originating from a direct-current power supply (measurement device 30) are connected to upper end portions of a cathode plate C and an anode plate A of an electrode cartridge 10, which is placed in a plating tank 20. It is now possible to supply power between the cathode plate C and the anode plate A.

An strain gauge HG, which is attached to the cathode plate C, is electrically connected to the measurement device 30. Accordingly, it is possible to measure a distortion of the cathode plate C.

A tube (not shown) coming from an air pump (not shown) is connected to a tube connection port 15*a*. And bubbles for removing hydrogen ions are injected through injection holes 15*c*, which are located in an opposite position relative to a lower end portion of the cathode plate C. This will prevent formation of pits.

Power is supplied to the cathode plate C and the anode plate A through operation of the measurement device 30, and a measurement of distortion of the cathode plate C is started. The measured data is sent to a note personal computer 40 through connecting cables K.

The note personal computer 40 calculates an internal stress of a film of plating with an expression (2) based on the data measured by the measurement device 30 and characteristic values inputted in advance associated with the plating liquid and the cathode plate C.

$$\sigma = Et^2\delta/[3(1-\nu)dl^2] \quad (2)$$

where σ is an internal stress of film of plating, l a length of plating section of cathode plate, t a thickness of cathode plate, E Young's modulus of cathode plate, v Poisson's ratio of cathode plate, δ a deflection of cathode plate and d a thickness of film of plating.

The system 100 described above, which is equipped with a strain gauge HG, is able to provide an accurate and easier measurement for an internal stress of a film of plating.

Because it is not necessary to read divisions with the naked eye in conducting a measurement using the system 100, different from a spiral plating stress meter 50, the system 100 is free of errors associated with reading.

Because the strain gauge HG is able to measure a minute distortion of a cathode plate, it is possible to remarkably increase the accuracy of measurement. Accordingly, it is possible to provide a film of plating which meets requirements for a use in a so-called nanotechnology requesting high accuracy.

It will now be appreciated from the foregoing description that the present invention is not limited to the particularly illustrated embodiment discussed above and may be carried out in various modified forms.

For example, although the electrode cartridge 10 has a connecting portion 16 which is divided into a plurality of portions, it may be possible to eliminate connecting portions 16*e*, 16*f*, 16*h* and 16*i* as long as the shield plate 13 is securely supported.

Although the electrode cartridge 10 according to the present embodiment has the flanges 11*b*, 11*c*, 12*b* and 12*c*, it may be possible to eliminate these flanges as long as the electrode cartridge 10 is supported so that the upper end portions of the cathode plate C and the anode plate A stay above the surface of a plating liquid.

Although the electrode cartridge 10 according to the present embodiment has the anode shell 14 whose cross section is rectangular, it may be possible to select any geometry such as a circle, an ellipse and a polygonal as long as the size of opening 14*a* and geometrical relationship are properly adjusted.

It goes without saying that although the system 100 according to the present embodiment has a power supply as an internal device belonging to the measurement device 30, it may be possible to select a separate configuration.

Although in the system 100 according to the present embodiment, a distortion ($\epsilon$) of the cathode plate C measured by the measurement device 30 is sent to the note personal computer 40, there may be some alternatives. One is that the measurement device 30 sends a change ($\nabla R$) in electric resistance to the note personal computer 40, where a distortion ($\epsilon$) is calculated. Another one is that the measurement device 30 calculates a deflection ($\delta$) based on a distortion ($\epsilon$) and sends it to the note personal computer 40.

Although in the system 100 according to the present embodiment, the note personal computer 40 calculates a thickness of a film of plating based on the expression (2), it may be possible to use any expression as long as it calculates a stress based on a distortion (deflection).

Although it is not a typical use of an electrode cartridge 10 according to the present invention, it may be possible to use the electrode cartridge 10 so as to support only a cathode plate C in a plating liquid when electroless plating is conducted.

Foreign priority document, JP2004-027300, filed on Feb. 3, 2004, is hereby incorporated by reference.

What is claimed is:

1. An electrode cartridge which is applied to measurement of an internal stress for a film of plating, the electrode cartridge comprising:

a cathode support for supporting a cathode plate in a plating liquid, said cathode support comprising a cathode main portion and a cathode connecting portion extending downwardly from the main portion, the cathode plate having a plating section, to a back surface of which a strain gauge is attached;

an anode support for supporting an anode plate in the plating liquid, said anode support comprising an anode main portion and anode connecting portions each of which has a protruding portion, the anode connecting portions extending downwardly from the anode main portion;

a shield plate which is disposed on the cathode connecting portion between the cathode support and the anode support; and an anode shell which is joined to the anode support for surrounding a periphery and an end portion of the anode plate in the plating liquid disposed between the anode connecting portions and a bottomless slit between the anode shell and each anode connecting portion so as to attach an anode bag to the anode shell, wherein the cathode connecting portion abuts the protruding portion to keep a constant distance between the cathode support and the anode support;

wherein a through hole is made in the shield plate in such a manner that the through hole confronts the plating section and has a geometry which is reduced by a first predetermined scale factor relative to a geometry of the plating section, and wherein an opening is made in the anode shell in such a manner that the opening confronts the plating section and has a geometry which is magnified by a second predetermined scale factor relative to the geometry of the plating section.

2. An electrode cartridge according to claim 1 further comprising a bubble supplying device, wherein the device extends from the cathode support to a portion opposite to a lower end of the cathode plate and injects bubbles from this portion.

3. A system for measuring an internal stress for a film of plating with the electrode cartridge according to claim 1, wherein the system comprises:

a plating tank for storing the plating liquid, in which the electrode cartridge supporting the cathode plate and the anode plate is soaked;

a power supply which is electrically connected to the cathode plate and the anode plate;

a measurement device which is electrically connected to the swain gauge attached to the cathode plate; and a computer for calculating the internal stress for the film of plating based on results obtained by the measurement device, characteristics of the cathode plate and characteristics of the film of plating.

4. A system for measuring an internal stress for a film of plating with the electrode cartridge according to claim 2, wherein the system comprises:

a plating tank for storing the plating liquid, in which the electrode cartridge supporting the cathode plate and the anode plate is soaked;

a power supply which is electrically connected to the cathode plate and the anode plate;

a measurement device which is electrically connected to the swain gauge attached to the cathode plate; and a computer for calculating the internal stress for the film of plating based on results obtained by the measurement device, characteristics of the cathode plate and characteristics of the film of plating.

5. An electrode cartridge which is applied to measurement of an internal stress for a film of plating, the electrode cartridge comprising:

a cathode support for supporting a cathode plate in a plating liquid, the cathode plate having a plating section, to a back surface of which a strain gauge is attached;

an anode support for supporting an anode plate in the plating liquid so that the anode plate is opposite to the cathode plate with a predetermined spacing;

a shield plate which is interposed between the cathode plate and the anode plate;

an anode shell which is joined to the anode support for surrounding a periphery and an end portion of the anode plate in the plating liquid disposed between anode connecting portions and a bottomless slit between the anode shell and each anode connecting portion so as to attach an anode bag to the anode shell, and, a bubble supplying device which extends from the cathode support to a portion opposite to a lower end of the cathode plate and injects bubbles from this portion;

wherein a through hole is made in the shield plate in such a manner that the through hole confronts the plating section and has a geometry which is reduced by a first predetermined scale factor relative to a geometry of the plating section, and wherein an opening is made in the anode shell in such a manner that the opening confronts the plating section and has a geometry which is magnified by a second predetermined scale factor relative to the geometry of the plating section; and wherein the bubble supplying device includes an air supply path and injection holes which are formed inside the cathode support.

6. A system for measuring an internal stress for a film of plating with the electrode cartridge according to claim 5, wherein the system comprises:

a plating tank for storing the plating liquid, in which the electrode cartridge supporting the cathode plate and the anode plate is soaked;

a power supply which is electrically connected to the cathode plate and the anode plate;

a measurement device which is electrically connected to the strain gauge attached to the cathode plate; and a computer for calculating the internal stress for the film of plating based on results obtained by the measurement device, characteristics of the cathode plate and characteristics of the film of plating.

* * * * *